US008192232B2

(12) United States Patent
Whiteman, Jr. et al.

(10) Patent No.: US 8,192,232 B2
(45) Date of Patent: Jun. 5, 2012

(54) CONNECTOR ASSEMBLY HAVING AN ELECTRICAL COMPENSATION COMPONENT

(75) Inventors: Robert Neil Whiteman, Jr., Middletown, PA (US); Christopher David Ritter, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 107 days.

(21) Appl. No.: 12/559,697

(22) Filed: Sep. 15, 2009

(65) Prior Publication Data

US 2011/0065320 A1 Mar. 17, 2011

(51) Int. Cl.
*H01R 13/66* (2006.01)

(52) U.S. Cl. ..... 439/620.01; 439/620.2

(58) Field of Classification Search ..... 439/620.01, 439/620.09, 620.2, 604
See application file for complete search history.

(56) References Cited

U.S. PATENT DOCUMENTS

| | | | | |
|---|---|---|---|---|
| 4,772,225 | A * | 9/1988 | Ulery | 439/620.09 |
| 6,168,469 | B1 | 1/2001 | Lu | |
| 6,932,649 | B1 | 8/2005 | Rothermel et al. | |
| 7,540,781 | B2 | 6/2009 | Kenny et al. | |
| 7,670,147 | B1 * | 3/2010 | Lee | 439/76.1 |
| 7,905,752 | B2 * | 3/2011 | Morikawa | 439/620.09 |
| 2006/0030216 | A1 * | 2/2006 | Horiba | 439/620 |
| 2009/0142959 | A1 * | 6/2009 | Chuang | 439/620.01 |
| 2009/0191758 | A1 * | 7/2009 | Aekins | 439/620.01 |
| 2010/0267283 | A1 * | 10/2010 | Pischl | 439/620.05 |

* cited by examiner

*Primary Examiner* — Hien Vu

(57) ABSTRACT

A connector assembly includes a contact module comprising a lead frame having contacts defining separate conductive paths. The contact module also includes a compensation component coupled to selected contacts and affecting signals transmitted along the conductive paths of the selected contacts. The contact module also includes a body overmolded over the contacts and the compensation component.

20 Claims, 6 Drawing Sheets

CONNECTOR ASSEMBLY HAVING AN ELECTRICAL COMPENSATION COMPONENT

BACKGROUND OF THE INVENTION

The subject matter herein relates generally to connector assemblies, and more particularly, to connector assemblies having electrical compensation components.

With the ongoing trend toward smaller, faster, and higher performance electrical components such as processors used in computers, routers, switches, etc., it has become increasingly desirable for the electrical interfaces along the electrical paths to also operate at higher frequencies and at higher densities with increased throughput. For example, performance demands for video, voice and data drive input and output speeds of connectors within such systems to increasingly faster levels.

Electrical connectors typically are arranged to be connected to complementary connector halves to form connector pairs. One application environment that uses such electrical connectors is in high speed, differential electrical connectors, such as those common in the telecommunications or computing environments. In a traditional approach, two circuit boards are interconnected with one another in a backplane and a daughter board configuration. However, similar types of connectors are also being used in cable connector to board connector applications. With the cable connector to board configuration, one connector, commonly referred to as a header, is board mounted and includes a plurality of signal contacts which connect to conductive traces on the board. The other connector, commonly referred to as a cable connector or a receptacle, includes a plurality of contacts that are connected to individual wires in one or more cables of a cable assembly. The receptacle mates with the header to interconnect the backplane with the cables so that signals can be routed therebetween.

However, such cable connectors are not without problems. For instance, as the throughput speed of such cable connectors increases, the cable connectors are more susceptible to performance degradation. Compensation for signal degradation is provided within the cable connectors and/or on the backplane boards. Such solutions have heretofore proven difficult. For example, the compensation may be provided relatively far from the source of degradation, which is typically at the interface between the cable connector and the header and/or at the interface of the wires of the cable with the contacts of the cable connector. Additionally, conventional cable connectors having compensation are expensive to manufacture. Known cable connectors that include compensation are bulky in design.

A need remains for a cable connector that overcomes at least some of the existing problems of signal degradation in a cost effective and reliable manner. A need remains for a cable connector that overcomes at least some of the existing problems of signal degradation in a compact solution.

BRIEF DESCRIPTION OF THE INVENTION

In one embodiment, a connector assembly is provided including a contact module comprising a lead frame having contacts defining separate conductive paths. The contact module also includes a compensation component coupled to selected contacts and affecting signals transmitted along the conductive paths of the selected contacts. The contact module also includes a body overmolded over the contacts and the compensation component.

In a further embodiment, a connector assembly is provided that includes a contact module that includes a lead frame having contacts defining separate conductive paths. A portion of at least two adjacent contacts are removed defining a gap therebetween such that the conductive paths of the contacts are interrupted. The contact module also includes a compensation component coupled to the at least two adjacent contacts having portions thereof removed. The compensation component spans the gaps to electrically connect the at least two adjacent contacts having portions thereof removed. The contact module includes a body overmolded over the contacts and the compensation component.

In a further embodiment, a connector assembly is provided that includes a housing having a front and a rear and contact modules loaded into the housing through the rear. The contact modules include a lead frame having contacts defining separate conductive paths. The lead frame defines a contact plane. A compensation component is coupled to selected contacts and affecting signals transmitted along the conductive paths of the selected contacts. A body is overmolded over the contacts and the compensation component that engages the housing when the contact module is loaded into the housing. The contact modules are positioned within the housing such that the contact planes are parallel to one another.

DETAILED DESCRIPTION OF THE INVENTION

Figure 1:
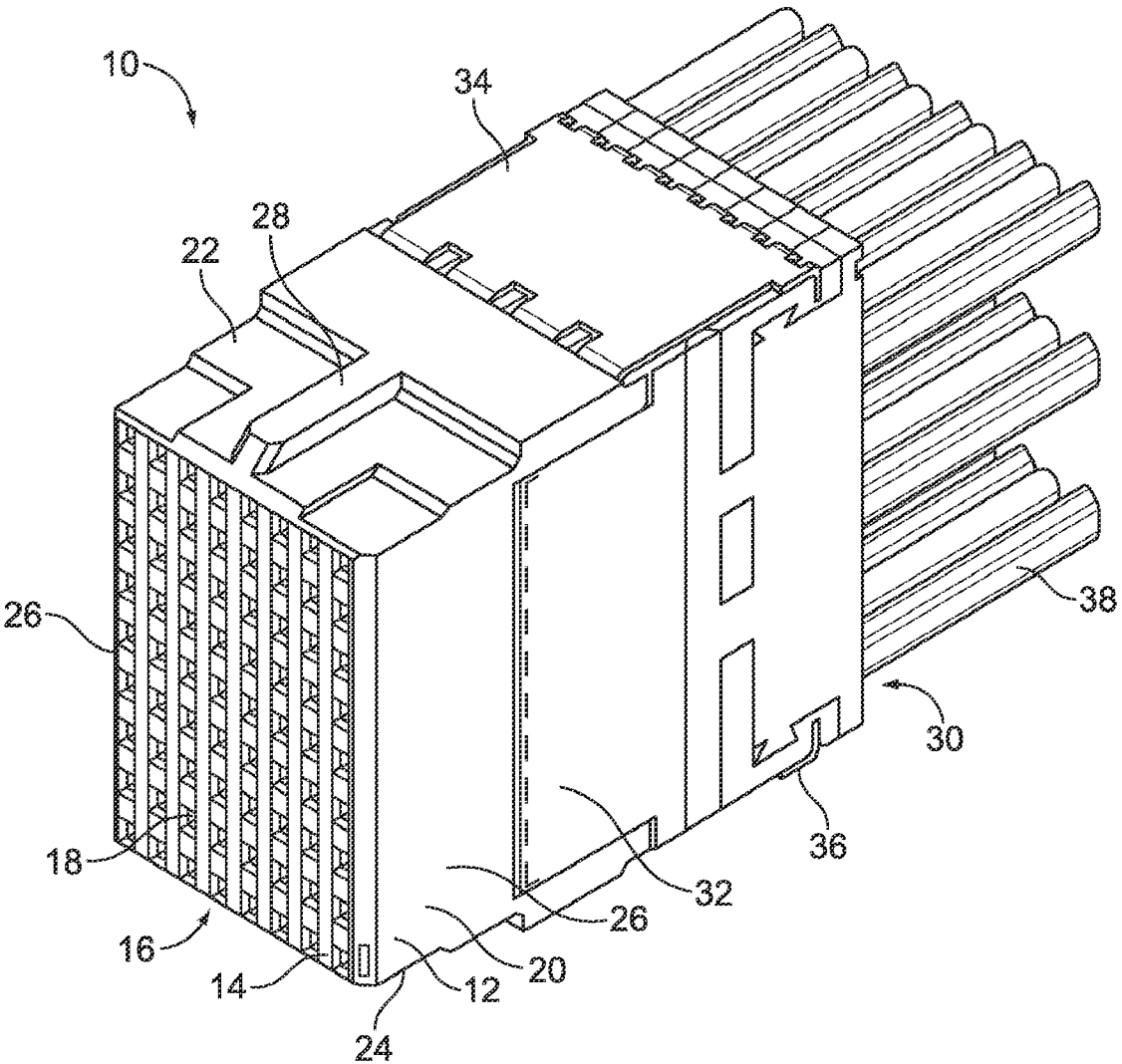
FIG. 1 is a front perspective view of a cable connector assembly formed in accordance with an exemplary embodiment.

FIG. 1 is a front perspective view of a cable connector assembly 10 formed in accordance with an exemplary embodiment. The receptacle connector assembly 10 is matable with a header connector assembly (not shown) to create a differential connector system. For example, the header connector assembly may be a Z-PACK TinMan header connector, which is commercially available from Tyco Electronics. While the receptacle connector assembly 10 will be described with particular reference to a high speed, differential cable connector, it is to be understood that the benefits herein described are also applicable to other connectors in alternative embodiments. The following description is therefore provided for purposes of illustration, rather than limitation, and is but one potential application of the subject matter herein.

As illustrated in FIG. 1, the receptacle connector assembly 10 includes a dielectric housing 12 having a forward mating end 14 that includes a mating interface 16 and a plurality of contact cavities 18. The contact cavities 18 are configured to receive corresponding mating contacts (not shown) from the header connector assembly. The housing 12 includes a plurality of support walls 20, including an upper shroud wall 22, a lower shroud wall 24 and side walls 26. Alignment ribs 28 are formed on the upper shroud wall 22 and lower shroud wall 24. The alignment ribs 28 cooperate to bring the receptacle connector assembly 10 into alignment with the header connector assembly during the mating process so that the mating contacts of the mating connector are received in the contact cavities 18 without damage.

A plurality of contact modules 30 are received in the housing 12 through a rearward loading end 32 of the housing 12. First and second clips 34, 36 are used to securely couple the contact modules 30 to the housing 12. Cables 38 are terminated to the contact modules 30. The receptacle connector assembly 10 thus defines a cable connector.

Figure 2:
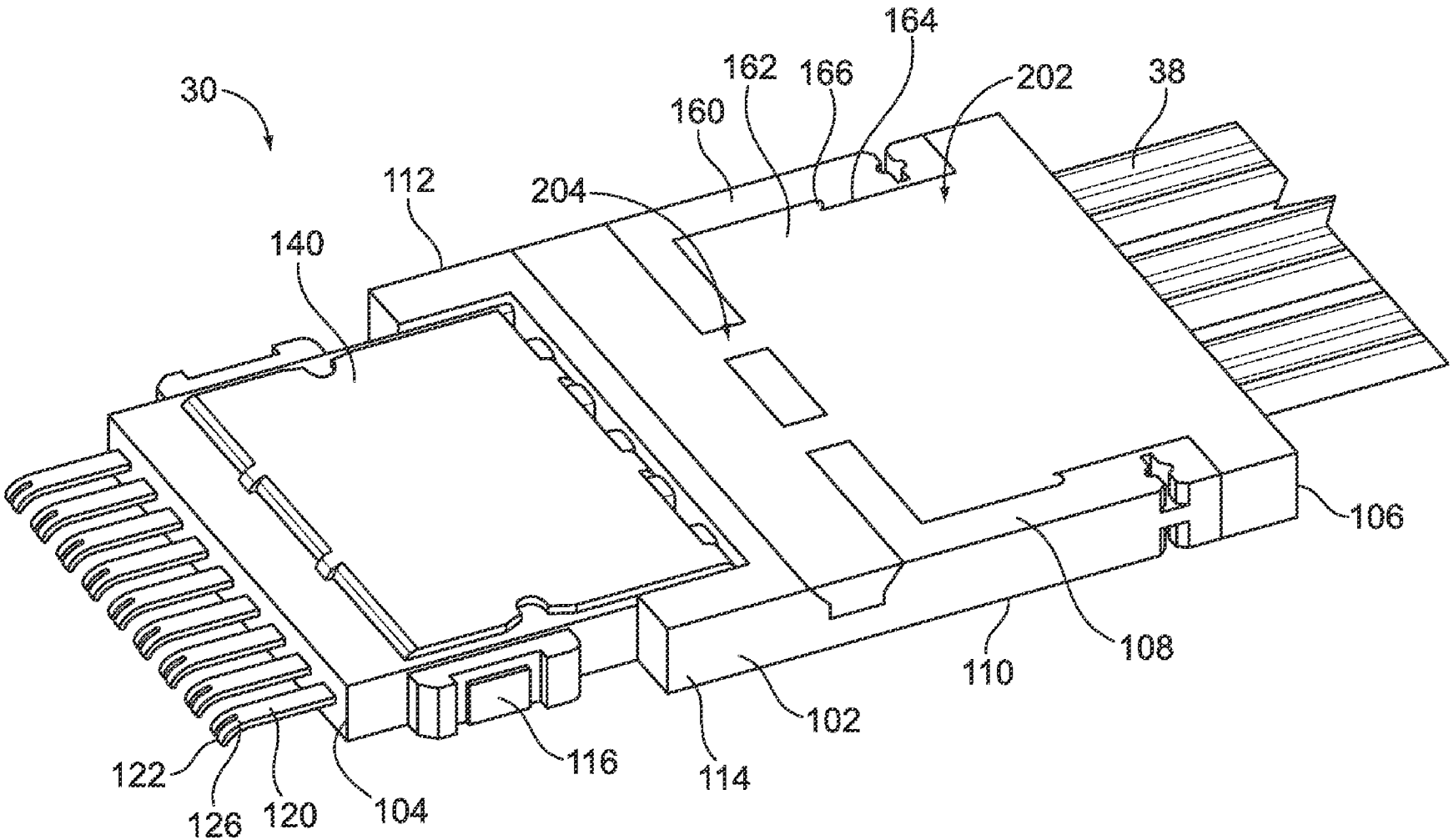
FIG. 2 is a front perspective view of a contact module for the cable connector assembly shown in FIG. 1.
Figure 3:
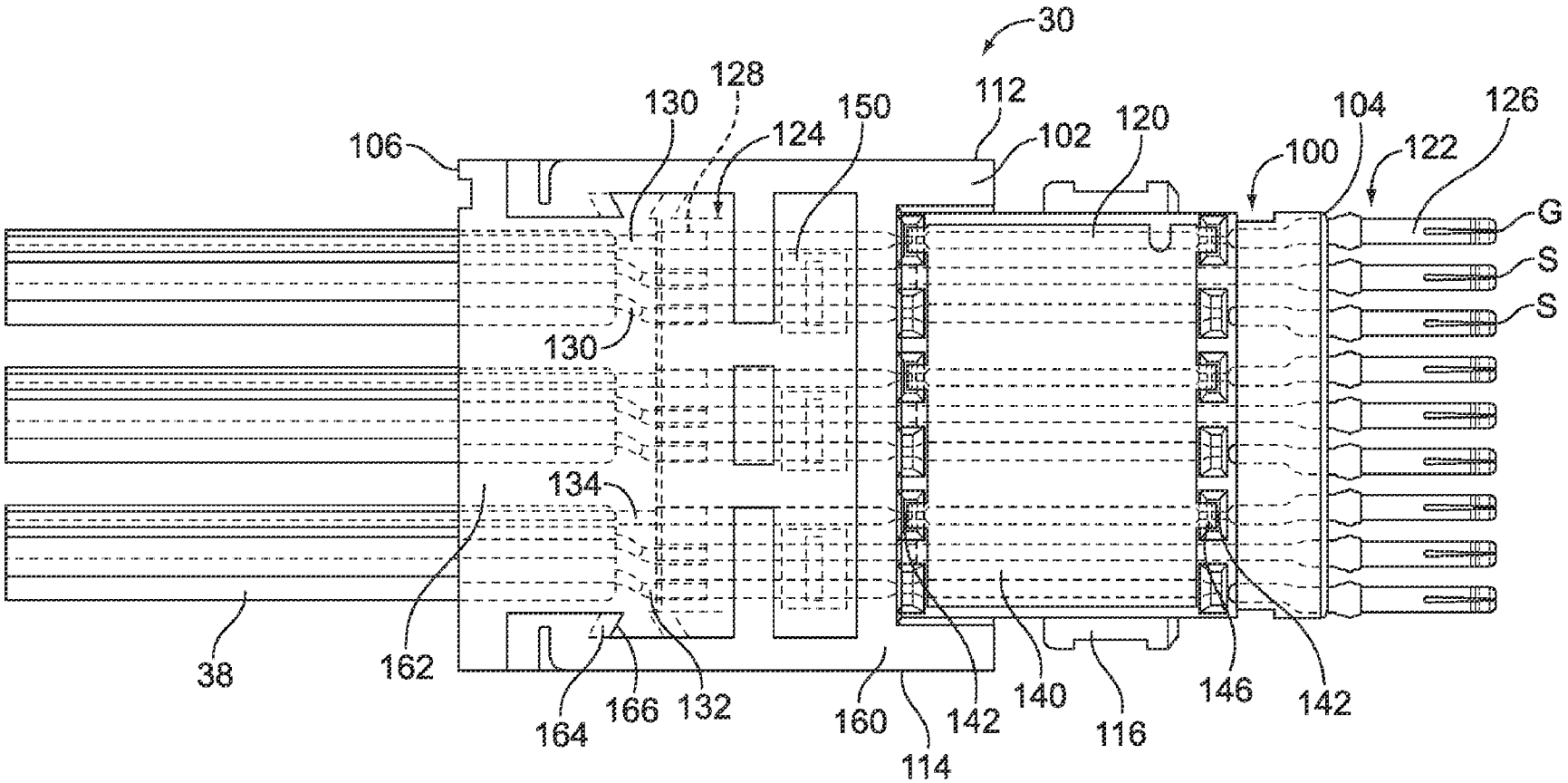
FIG. 3 is a side view of the contact module illustrating a leadframe of the contact module in phantom.

FIG. 2 is a front perspective view of an exemplary contact module 30 that is matable with the housing 12 (shown in FIG. 1). FIG. 3 illustrates an internal structure, including an internal lead frame 100, of the contact module 30 in phantom. The contact module 30 includes a dielectric body 102 that surrounds the lead frame 100. In some embodiments, the body 102 is manufactured using an overmolding process. During the overmolding process, the lead frame 100 is encased in a dielectric material, such as a plastic material, which forms the body 102. Optionally, the contact module 30 may be manufactured in stages that include more than one overmolding processes (e.g. an initial overmolding and a final overmolding).

As illustrated in FIG. 2, the body 102 extends between a forward mating end 104 and a rear end 106. The cables 38 extend rearward from the rear end 106. The body 102 includes opposed first and second generally planar side surfaces 108 and 110, respectively. The side surfaces 108 and 110 extend substantially parallel to and along the lead frame 100. The body 102 includes opposed top and bottom ends 112, 114. Optionally, ribs 116 may be provided on each of the top and bottom ends 112, 114. The ribs 116 may be used to guide and/or orient the contact modules 30 into the housing 12.

As illustrated in FIG. 3, the lead frame 100 includes a plurality of contacts 120 that extend between mating ends 122 and wire terminating ends 124. Mating contacts 126 are provided at the mating ends 122, and the mating contacts 126 are loaded into the contact cavities 18 (shown in FIG. 1) of the housing 12 for mating with corresponding mating contacts of the header connector assembly (not shown). The contacts 120 define wire mating portions proximate to the wire terminating ends 124. For example, the contacts 120 may include solder pads 128 at the wire terminating ends 124 for terminating to respective wires 130 of the cable 38 by soldering or welding. Other terminating processes and/or features may be provided at the wire terminating ends 124 for terminating the wires 130 to the contacts 120. For example, insulation displacement contacts, wire crimp contacts, and the like may be provided at the wire terminating ends 124. The mating contacts 126 and/or the solder pads 128 may be formed integrally with the contacts 120, such as by a stamping and/or forming process, or the mating contacts 126 and/or the solder pads 128 may be separately provided and electrically connected to the contacts 120. The wire terminating ends 124, including the solder pads 128, are encased within the body 102. The body 102 is overmolded over the wire terminating ends 124 and the solder pads 128. In an exemplary embodiment, the body 102 is overmolded over the wires 130 after the wires 130 are soldered to the solder pads 128. Optionally, such overmolding of the wires 130 and the solder pads 128 may be accomplished during a secondary overmolding process.

In an alternative embodiment, the terminating ends 124 of the contacts 120 may include mounting pins extending from the body 102 for mounting to a circuit board, rather than for terminating to the wires 130. In such an embodiment, the contact module defines a board mounted contact module rather than a cable mounted contact module. The terminating ends may extend from the rear end 106. Alternatively, the terminating ends may extend from another end, such as the bottom end 114.

An exemplary manufacture or assembly of the contact module 30 may be described with reference to FIG. 3. As described above, the body 102 may be overmolded over the lead frame 100 in a multiple step process. For example, the body 102 may be overmolded in a first overmold to form a base 160 and in a second overmold to form a cover 162 that cooperates with the base 160 to form the body 102. In an exemplary embodiment, the lead frame 100 is initially overmolded such that the contacts 120 are firmly held by the base 160 of the body 102. The base 160 supports the majority of the contacts 120, however, portions of the contacts may remain exposed after the base 160 is overmolded. For example, the solder pads 128 are exposed rearward of the base 160. The mating contacts 126 are exposed forward of the base 160. In an exemplary embodiment, side surfaces of the contacts 120 are exposed along one or more segments of the contacts 120.

As will be described in further detail below, after the first overmolding process, compensation components 150 may be connected to the exposed side surfaces of the contacts 120. Additionally, after the first overmolding process, the wires 130 of the cable 38 may be terminated to the solder pads 128. After the wires 130 are terminated to the solder pads 128 and after the compensation components 150 are electrically connected to selected ones of the contacts 120, the body 102 is overmolded a second time, forming the cover 162 of the body 102. The cover 162 is overmolded around the cables 38 and wires 130 to securely retain the cables 38 and wires 130 within the contact module 30 and/or to provide strain relief to resist pulling of the wires 130 away from the solder pads 128. The cover 162 is overmolded around the compensation components 150 to securely retain the compensation components 150 within the contact module 30.

The cover 162 is secured to the base 160, such as by forming keys 164, 166 in the base 160 and cover 162. The cover 162 may be secured to the base 160 by a chemical or mechanical bond at the interface between the cover 162 and the base 160. For example, heat and pressure used to create the cover 162 may cause bonding with the base 160. Because the base 160 and the cover 162 are individually molded, a line of weakness may be created between the base 160 and the cover 162. Excessive strain, such as pulling on the cables 38, may cause the cover 162 to separate from, or pull away from, the base 160, which may also break the electrical connection between the wires 130 and the contacts 120 or between the compensation components 150 and the contacts 120. In an exemplary embodiment, the clips 34, 36 (shown in FIG. 1) are used to add stability to the body 102 to resist separation of the cover 162 from the base 160.

In an exemplary embodiment, the contacts 120 are arranged generally parallel to one another between the mating ends 122 and wire terminating ends 124, and the mating ends 122 and the wire terminating ends 124 are provided at generally opposite ends of the contact module 30. However, other configurations of contacts 120 may be provided in alternative embodiments, such that the contacts 120 and/or at least one of the mating and/or wire terminating ends 122, 124 have different arrangements or positions.

The contacts 120 are grouped together and arranged in a predetermined pattern of signal, ground and/or power contacts. In the illustrated embodiment, the contacts 120 are arranged in groups of three contacts 120 that have two signal contacts carrying differential signals and one ground contact.

The group of contacts 120 are adapted for connection with cables 38 having two differential signal wires 132 and a ground wire 134. In one embodiment, as illustrated in FIG. 3, the pattern of contacts 120 is a ground-signal-signal pattern (from the top end 112 to the bottom end 114 of the body 102). As such, a ground contact is arranged between each adjacent pair of signal contacts. In another embodiment, the pattern of contacts 120 is a signal-signal-ground pattern (from the top end 112 to the bottom end 114 of the body 102).

In an exemplary embodiment, the lead frame 100 and body 102 are universal, such that the pattern of contacts 120 may be established by the coupling of the signal or ground wires 132, 134 to the contacts 120. For example, if the ground wire 134 is terminated to the top-most contact 120 of each grouping, then the contact module 30 will have a ground-signal-signal pattern, whereas, if the ground wire 134 is terminated to the bottom-most contact 120 of each grouping, then the contact module 30 will have a signal-signal-ground pattern. As such, the same contact modules 30 may be mated within the housing 12, but the patterns of the contacts 120 of different ones of the contact modules 30 within the housing 12 may be different. For example, adjacent ones of the contact modules 30 within the housing 12 may have different patterns of contacts 120.

In an exemplary embodiment, the contact module 30 may include a commoning member 140, similar to the commoning member described in U.S. patent application Ser. No. 11/969,716 filed Jan. 4, 2008, titled CABLE CONNECTOR ASSEMBLY, the complete disclosure of which is herein incorporated by reference in its entirety. The commoning member 140 may be used to define which of the contacts 120 of the lead frame 100 define ground contacts. When connected, the commoning member 140 interconnects and electrically commons each of the ground contacts to which the commoning member 140 is connected. As such, the commoning member 140 commons the individual conductive paths of the ground contacts 120 together. For example, the commoning member 140 may be mechanically and electrically connected to each of the ground contacts within the lead frame 100. In an exemplary embodiment, certain ones of the contacts 120 may include grounding portions 142 to which the commoning member 140 is connected. Optionally, the commoning member 140 may connect to the ground contacts at multiple points along each ground contact, such as proximate to the mating end 122 and the wire terminating end 124 thereof. In an exemplary embodiment, the orientation of the commoning member 140 with respect to the body 102 may define the contact pattern (e.g. ground-signal-signal versus signal-signal-ground).

Figure 4:
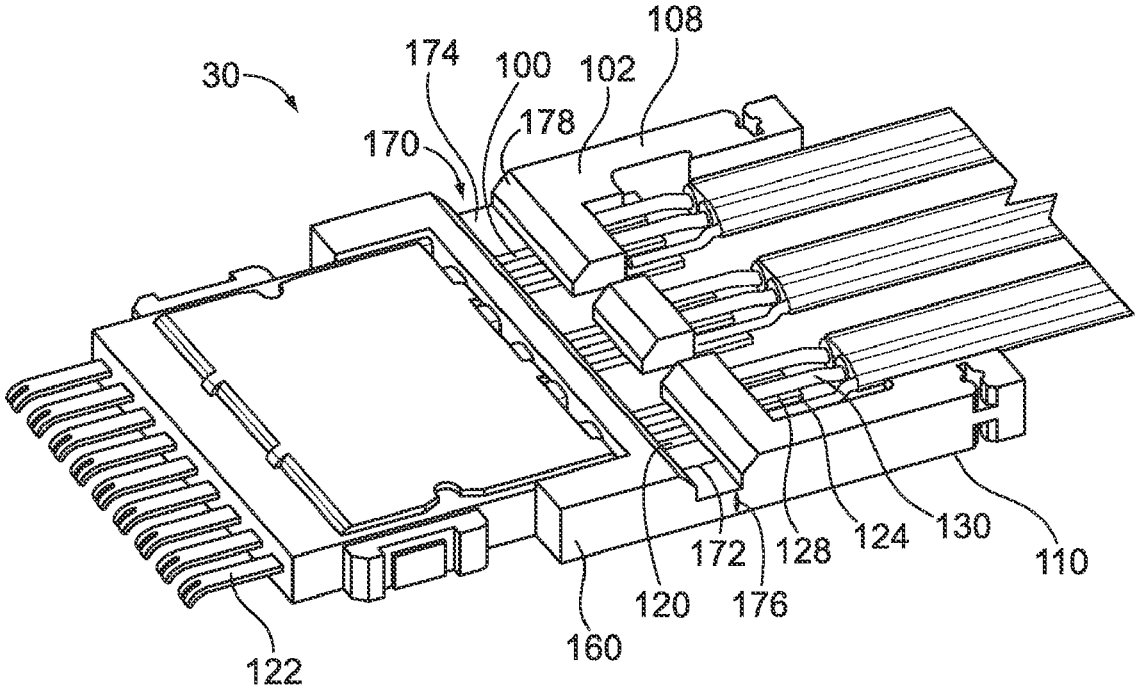
FIG. 4 illustrates the contact module during a first stage of manufacture.

FIG. 4 illustrates the contact module 30 during a first stage of manufacture. As noted above, the body 102 is manufactured in multiple stages. In the first stage of manufacture, the base 160 of the body 102 is formed during a first overmolding process. The base 160 is created by forming a plastic material into a structure around the lead frame 100 using heat and pressure. For example, a mold may be positioned around the lead frame 100, and then the mold may be filled, such as by an injection process, with the plastic material. When the mold is removed, the base 160 has a particular shape, and the lead frame 100 is held by the base 160 in a particular configuration. The base 160 is a generally rigid structure once formed.

The wire terminating ends 124 of the contacts 120 extend rearward from the base 160. Optionally, the base 160 may support portions of the wire terminating ends 124. For example, the base 160 may extend beneath the solder pads 128 to support one side of the solder pads 128, while the opposite side of the solder pads 128 remain exposed for termination of the wires 130 thereto. Alternatively, as in the illustrated embodiment, the solder pads 128 may be unsupported by the base 160, but rather may extend rearward from the base 160 in a cantilevered fashion. The wires 130 are terminated to the solder pads 128.

In an exemplary embodiment, the base 160 is formed with a channel 170 extending perpendicular to the contacts 120. The channel 170 extends inward from the side 108 to the body 102, thus exposing the contacts 120. The portions of the contacts 120 that are exposed constitute exposed segments 172 of the contacts 120. The base 160 is positioned below the channel 170 and the exposed segments 172 of the contacts 120. As such, the base 160 operates as a supporting structure for the exposed segments 172, as the exposed segments 172 rest directly upon an exposed surface 174 at a bottom of the channel 170. The base 160 has a thickness 176 between the exposed surface and the side 110 of the body 102 below the contacts 120. The thickness 176 may be approximately half the thickness of the body 102 between the sides 108, 110. The channel 170 also includes side walls 178 that extend outward from the exposed surface 174 to the side 108.

The exposed segments 172 are provided between the mating ends 122 and the wire terminating ends 124. In the illustrated embodiment, the exposed segments 172 are positioned remote from the mating ends 122 and the wire terminating ends 124, such that portions of the base 160 are provided between the exposed segments 172 and the mating ends 122 and the wire terminating ends 124, respectively. The exposed segments 172 are positioned proximate to the wire terminating ends 124 in the illustrated embodiment, however, the exposed segments 172 may be positioned elsewhere in alternative embodiments. The exposed segments 172 are represented by a side surface of the contacts 120. Optionally, each contact 120 may have more than one exposed segment 172. Optionally, only certain ones of the contacts 120 may include an exposed segment 172. Any length of the contacts 120 may be part of the exposed segment 172.

Figure 5:
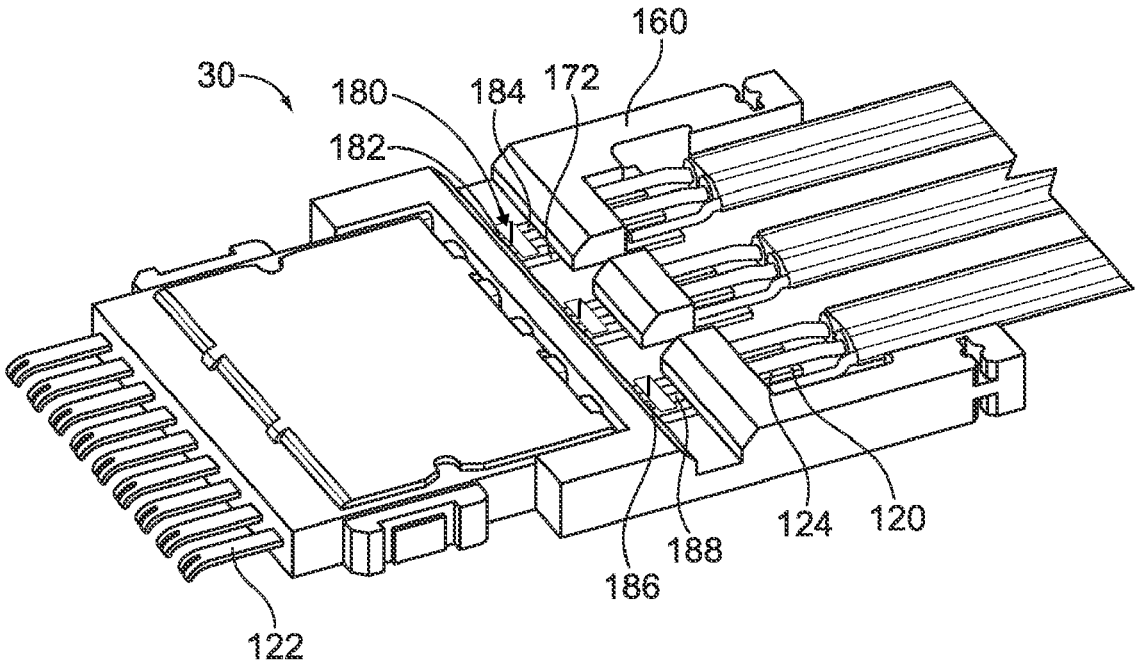
FIG. 5 illustrates the contact module during a second stage of manufacture.

FIG. 5 illustrates the contact module 30 during a second stage of manufacture. During the second stage of manufacture, portions of selected ones of the contacts 120 are removed to form gaps 180. For example, portions of the exposed segments 172 are removed. In an exemplary embodiment, portions of the base 160 below the exposed segments 172 are also removed simultaneously. For example, the base 160 and the exposed segments 172 may be removed by a cutting or drilling process. Other processes may be used in alternative embodiments to remove the portions of the contacts 120 and/or the base 160. Any number of the contacts 120 may have portions removed to create discontinuities along the conductive paths of the contacts 120. As such, the conductive paths are non-continuous between the mating end 122 and the wire terminating ends 124.

The gap 180 creates a physical separation between different portions of the contacts 120. A mating segment 182 is defined on one side of the gap 180 between the gap 180 and the mating end 122. A terminating segment 184 is defined on the other side of the gap 180 between the gap 180 and the wire terminating end 124. The mating segment 182 and the terminating segment 184 have contact pads 186, 188, respectively, adjacent the gap 180. The contact pads 186, 188 are defined by the portions of the exposed segment 172 that remains after the other portion of the exposed segment 172 is removed. The contact pads 186, 188 are positioned between the gap 180 and the side walls 178.

In the illustrated embodiment, each of the contact sets include removed portions. Optionally, both signal contacts of the contact sets have removed portions, while the ground contacts of the contact sets remains intact and have continuous ground paths between the mating ends 122 and the wire terminating ends 124. Alternatively, only one of the signal contacts may have a removed portion. Alternatively, even the ground contacts may include removed portions. In some alternative embodiments, less than all of the contact sets include removed portions.

Figure 6:
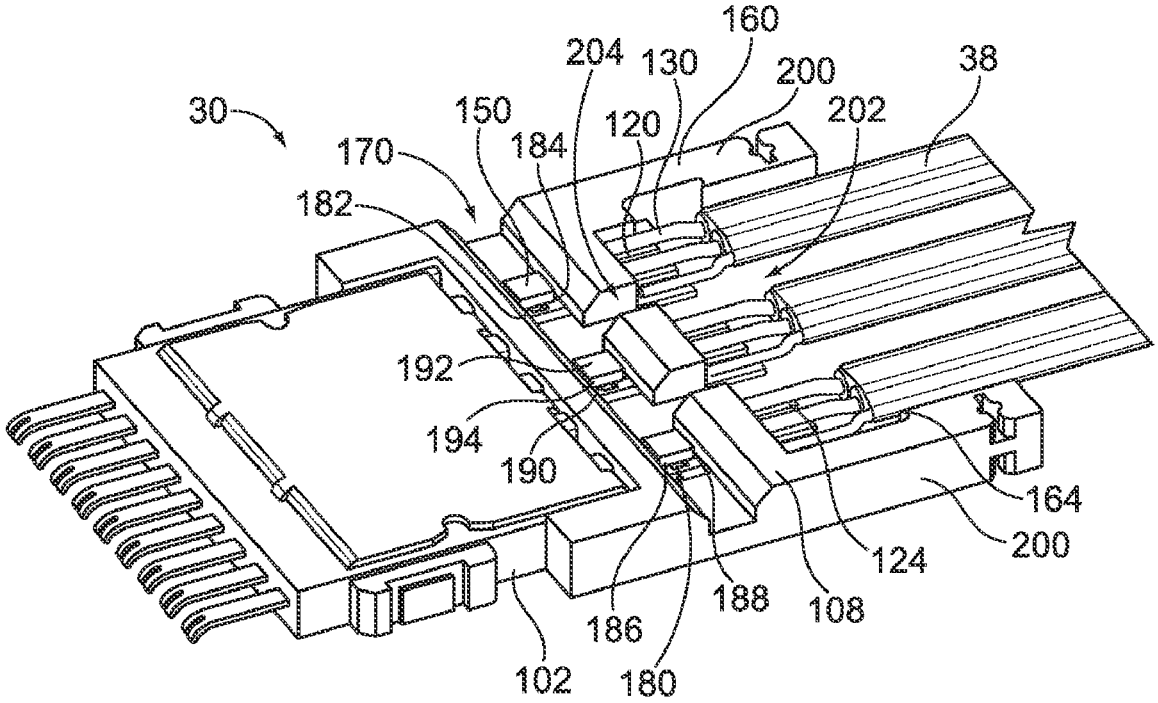
FIG. 6 illustrates the contact module during a third stage of manufacture.

FIG. 6 illustrates the contact module 30 during a third stage of manufacture. During the third stage of manufacture, the compensation components 150 are directly coupled to the contacts 120 that have the removed portions. The compensation components 150 are discrete electrical components that are mechanically and electrically connected to the contacts 120. The compensation components 150 may be coupled to the base 160 of the body 102 in addition to being coupled to the contacts 120.

The compensation components 150 affect the electrical characteristics of the signals being transmitted by the contacts 120. The compensation components 150 are passive electrical devices that are used to control the electrical characteristics of the signals being transmitted by the contacts 120. In an exemplary embodiment, the compensation components 150 are attenuators that are used to lower voltage, dissipate power, and/or to improve impedance matching. The attenuator may include any type of circuit used in RF and AF attenuators, such as PI pads (π-type) or T pads. The compensation components 150 may be other types of integrated circuits in alternative embodiments that affect the electrical characteristics in other ways. The compensation components 150 may be active electrical devices in alternative embodiments.

Compensation components 150 are connected to each of the contacts 120 that have the removed portions. The compensation components 150 bridge the gap 180 to reconnect the conductive paths of the contacts 120. Signals transmitted along the contacts 120 are transmitted through the compensation components 150. The compensation components 150 are mechanically and electrically coupled to the contact pads 186, 188. For example, the compensation components 150 may be soldered to the contact pads 186, 188. The compensation components 150 interconnect the mating segments 182 and the terminating segments 184 of the corresponding contacts 120. Each compensation component 150 may be connected to any number of the contacts 120, and may interconnect the contact segments in any manner desired.

In an exemplary embodiment, each compensation component 150 is connected to a pair of signal contacts within the contact sets. As such, each compensation component 150 is connected to two mating segments 182 and two terminating segments 184. The compensation component 150 electrically connects the mating segment 182 and the terminating segment 184 of a given contact 120 together using a circuit component such as a resistor. The compensation component 150 also electrically connects the two mating segments 182 together and the two terminating segments 184 together, such as with resistors.

The compensation component 150 includes an inner end 190, an outer end 192 and sides 194 extending between the inner and outer ends 190, 192. The inner end 190 is terminated to the selected contacts 120 at the contact pads 186, 188. The inner end 190 is generally co-planar with the contacts 120 when mounted thereto. The sides 194 define a height of the compensation component 150 measured from the inner end 190, which is mounted to the contacts 120. In an exemplary embodiment, the compensation component 150 has a low profile, wherein the overall height of the compensation component 150 is relatively short, such that the compensation component 150 does not add bulk to the contact module 30. The outer end 192 does not extend by a measurable amount beyond the side 108 of the body 102. In the illustrated embodiment, the outer end 192 is recessed below the side 108 such that the compensation component 150 does not extend outward from the body 102 at all.

Once the compensation components 150 are mounted to the contacts 120, the secondary overmolding process may begin. During the secondary overmolding process, a dielectric material, such as a plastic material, is overmolded into the channel 170 over the compensation components 150 to form the cover 162 (shown in FIG. 2). In an exemplary embodiment, the cover 162 is molded over the sides 194 and the outer end 192. Alternatively, the cover 162 is molded over the sides 194, but the outer end 192 remains exposed through the cover 162. For example, the outer end 192 may be flush with the cover 162. Alternatively, the outer end 192 may be elevated beyond the cover 162 or recessed below the cover 162 but remain exposed.

In an alternative embodiment, the compensation components 150 may be terminated to the contacts 120 prior to the first overmolding process. The leadframe and the compensation components 150 may be simultaneously overmolded during one or more overmolding processes.

In an exemplary embodiment, the base 160 includes rear arms 200 positioned rearward of the channel 170. Between the rear arms 200 is a cavity 202. The wire terminating ends 124 extend into the cavity 202 and are bounded above and below by the rear arms 200. The cables 38 extend into the cavity 202 and are terminated to the wire terminating ends 124 within the cavity 202. In an exemplary embodiment, during the secondary overmolding process, the cavity 202 is filled with a dielectric material, such as a plastic material, to overmold the wire terminating ends 124 and the cables 38. The dielectric material forms the cover 162. The rear arms 200 may include the keys 164 and the plastic material is able to engage the keys 164 to form the keys 166 of the cover 162.

Optionally, grooves 204 may extend between the channel 170 and the cavity 202, and the plastic material is able to flow through the grooves 204 during the overmolding process between the channel 170 and the cavity 202. As such, the channel 170 and the cavity 202 may be overmolded at the same time. Alternatively, the channel 170 and the cavity 202 may be filled separately during different overmolding processes. As such, two different covers 162 may be formed.

Returning to FIG. 2, the body 102 is illustrated with the cover 162 overmolded within the base 160. The cover 162 fills the channel 170, the grooves 204 and the cavity 202. The cover 162 is overmolded over the compensation components 150 (shown in FIG. 6), the wire termination ends 124 (shown in FIG. 6) and the cables 38. The outer surface of the cover 162 is substantially flush with the base 160. Alternatively, the cover 162 may be recessed or elevated with respect to the base 160 such that the cover 162 is not flush with the base 160.

In an exemplary embodiment, the second overmolding process is performed differently than the first overmolding process. For example, the cover 162 may be formed at a different temperature or pressure than the base 160, such as a lower temperature or a lower pressure. In order to reduce the risk of damaging the compensation components 150 or the connection between the compensation components 150 or the wires 130 (shown in FIG. 6) with the contacts 120, the pressure and/or temperature used to form the cover 162 may be less than the pressure and/or temperature used to form the cover 162. For example, if the temperature of the material used to create the cover 162 is too high, the solder used to electrically and mechanically secure the compensation components 150 or the wires 130 to the contacts 120 may be reflowed, which could affect the connection therebetween. Also, if the temperature were too high, then the material forming the base 160 could start to melt or otherwise be damaged. Similarly, if the pressure used to create the cover 162 is too high, the solder used to electrically and mechanically secure the compensation components 150 or the wires 130 to the contacts 120 could be damaged. As such, in an exemplary embodiment, the second overmolding process is performed at a lower temperature and a lower pressure.

Optionally, a different type of material may be used to form the cover 162 than is used to form the base 160. For example, a material that melts at a lower temperature may be used, as the second overmolding process is performed at a lower temperature. The material used for the cover 162 may have a different dielectric constant which may affect the electrical characteristics of the contacts 120 and/or the compensation components 150. In an exemplary embodiment, the cover 162 is formed by overmolding a potting material to fill the channel 170 and the cavity 202. The potting material is overmolded by spreading the potting material into the channel 170 and the cavity 202, rather than injection molding material into a mold. Alternatively, a hot melt glue may be used as the material forming the cover 162 that fills the channel 170 and the cavity 202. In other embodiments, the same type of material may be used for the second overmolding process and the second overmolding process may be performed at substantially the same temperature and pressure as the first overmolding process.

Figure 7:
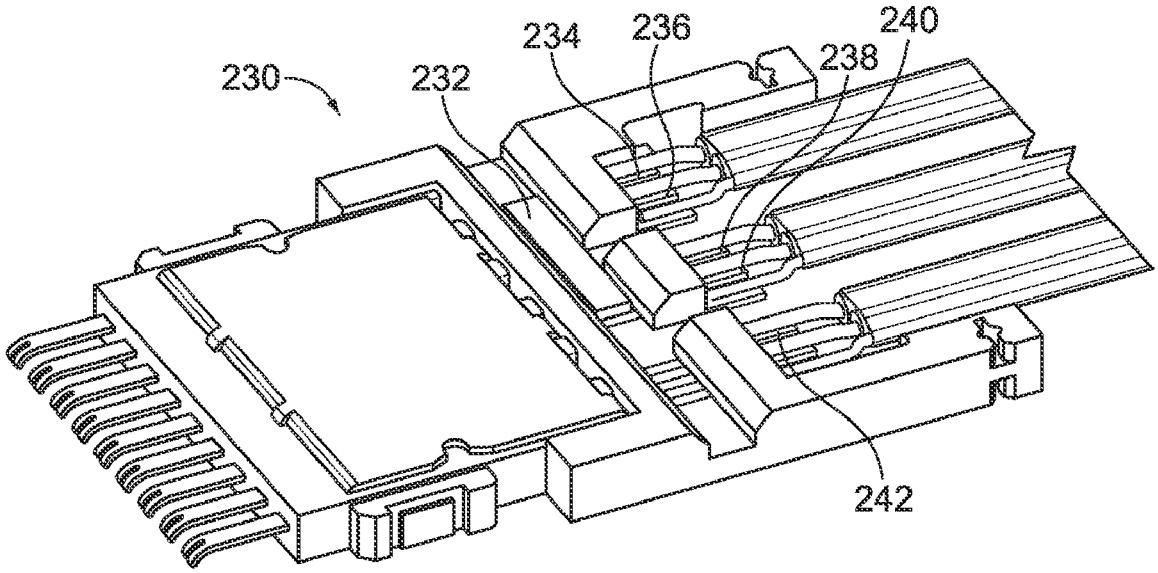
FIG. 7 illustrates an alternative contact module.

FIG. 7 illustrates an alternative contact module 230 during an intermediate stage of manufacture. The contact module 230 is similar to the contact module 30, however the contact module 230 includes a single compensation component 232 that spans across multiple contact sets. The compensation component 232 is mounted to first and second contacts 234, 236 and is also mounted to third and fourth contacts 238, 240. The compensation component 232 is not mounted to the ground contacts of the contact sets. However, in an alternative embodiment, the compensation component 232 may be electrically connected to at least one grounded component, such as one or more of the ground contacts. One of the contact sets does not include a compensation component mounted thereto, but rather, the contacts 242 have continuous, uninterrupted conductive paths.

In the illustrated embodiment, the compensation component 232 provides compensation for the contacts 234, 236, 238, 240. The compensation component 232 includes circuitry that completes the conductive paths of each of the contacts 234, 236, 238, 240. The compensation component 232 also includes circuitry that creates circuits between the first and second contacts 234, 236 and that creates circuits between the third and fourth contacts 238, 240.

Once the compensation component is mounted to the contacts 234, 236, 238, 240, a second overmolding process occurs to overmold a cover (not shown) over the compensation component 232. The cover may be overmolded in a similar manner as described with respect to the cover 162 (shown in FIG. 2).

Other configurations for compensation modules are possible in alternative embodiments. Any of the contacts or contact sets may be coupled to a compensation component. The compensation component may or may not be coupled to both contacts within a contact set.

Figure 8:
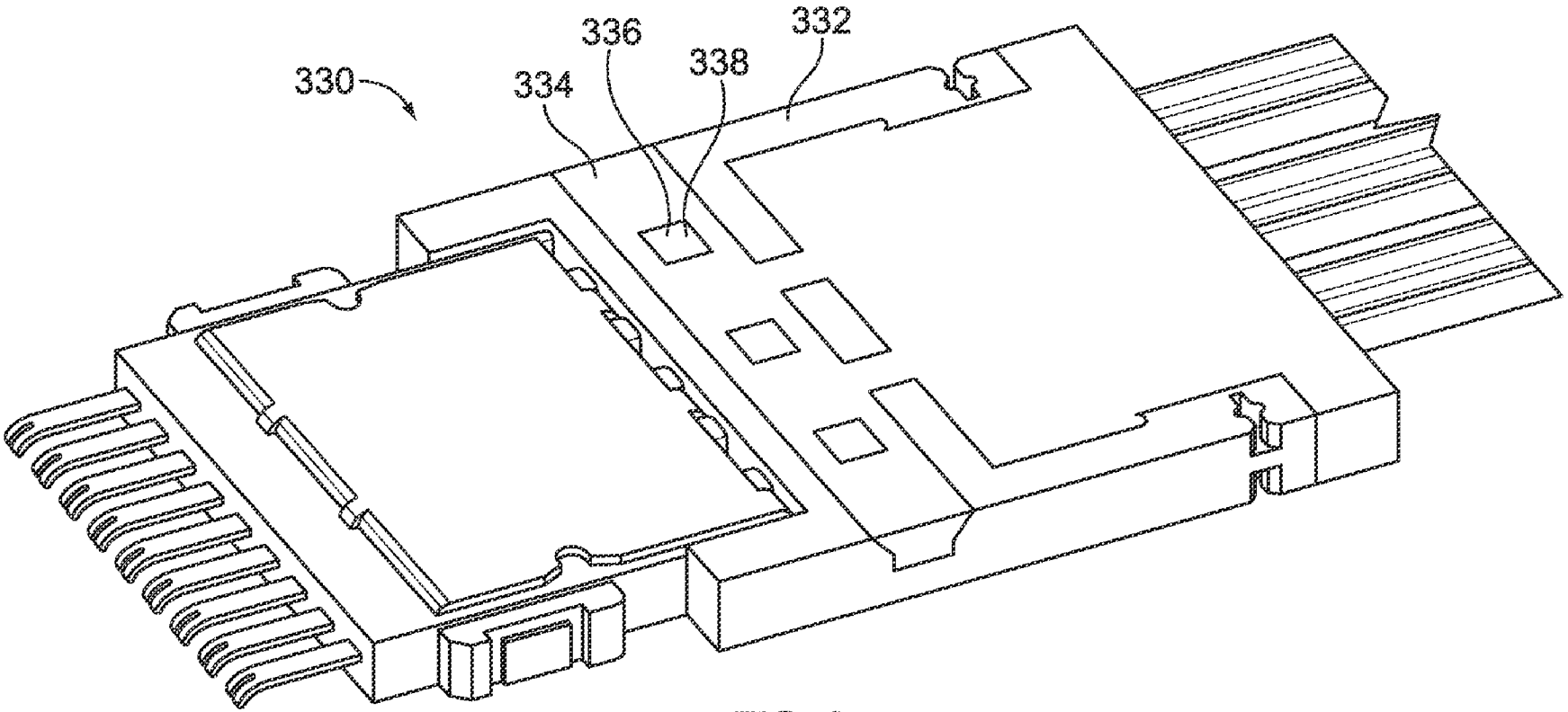
FIG. 8 illustrates another alternative contact module.

FIG. 8 illustrates another alternative contact module 330. The contact module 330 is similar to the contact module 30. The contact module 330 includes a base 332 and a cover 334 overmolded during separate overmolding processes. The contact module 330 includes compensation components 336. The cover 334 is overmolded over the compensation components 336 such that an outer end 338 of each compensation component 336 is exposed through the cover 334. In the illustrated embodiment, the outer ends 338 of the compensation components 336 are flush with the cover 334. The cover 334 is molded over the compensation components 336 such that the cover engages the sides of the compensation components 336 to hold the compensation components 336 relative to the base 332.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a contact module comprising a lead frame having contacts defining separate conductive paths, the contact module comprising a compensation component mounted to selected ones of the contacts, the compensation component forming part of the conductive paths of the selected ones of the contacts and affecting signals transmitted along the conductive paths, the contact module comprising a body encasing and engaging the contacts and the compensation component, wherein the body includes a base and a cover, the base being formed during a first overmolding process, the cover being formed during a second overmolding process, the contacts being encased in the base, the base having a channel exposing a portion of the contacts, the compensation component being mounted to the contacts within the channel, the cover at least partially filling the channel to at least partially encase the compensation component.

2. The connector assembly of claim 1, wherein the contacts include a first contact and a second contact, both the first and second contacts having a portion thereof removed to define a gap between segments of the first and second contacts, the compensation component bridging the gap to electrically couple the segments of the first and second contacts.

3. The connector assembly of claim 1, wherein the contacts extend between mating ends and terminating ends, at least one of the contacts having an electrical discontinuity such that the conductive path is non-continuous between the mating end and the terminating end, the compensation component being coupled to the contact at the discontinuity such that the compensation component forms part of the conductive path.

4. The connector assembly of claim 1, wherein the contacts extend between mating ends and terminating ends, at least one of the contacts having a discontinuity defining a mating segment on one side of the discontinuity and a terminating segment on another side of the discontinuity, the mating segment and the terminating segment being separated by a gap, the mating segment and the terminating segment having contact pads adjacent the gap, the compensation component being connected to the mating segment and the terminating segment at the contact pads thereof.

5. The connector assembly of claim 1, wherein a portion of at least one contact is removed after encased by the body to define a non-continuous conductive path, the compensation component being coupled to the contact to bridge the removed portion of the at least one contact, the compensation component being encased by the body after the compensation component is coupled to the contact.

6. The connector assembly of claim 1, wherein the body is formed during a first overmolding process and a second overmolding process, the first overmolding process forming a supporting structure for the contacts leaving at least a portion of the contacts exposed, the compensation component being coupled to the exposed portion of the selected contacts, the second overmolding process encasing at least a portion of the compensation component.

7. The connector assembly of claim 1, wherein the body includes a base and a cover, the base being formed during a first overmolding process, the cover being formed during a second overmolding process, the contacts being held by the base, the compensation component being mounted to the base and the selected contacts, the cover encasing at least a portion of the compensation component.

8. The connector assembly of claim 1, wherein the compensation component includes an inner end, an outer end and sides extending between the inner and outer ends, the inner end being terminated to the selected contacts, the body being overmolded over the compensation component such that the body engages the sides.

9. The connector assembly of claim 1, wherein the compensation component is completely encased by the body.

10. A connector assembly comprising:

a contact module comprising a lead frame having contacts defining separate conductive paths, at least two adjacent contacts having portions thereof removed defining a gap along the conductive paths thereof such that the conductive paths of the contacts are interrupted;

the contact module comprising a compensation component coupled to the at least two adjacent contacts having portions thereof removed, the compensation component spanning the gaps to electrically connect the at least two adjacent contacts having portions thereof removed; and the contact module comprising a body encasing and engaging portions of the contacts and portions of the compensation component, wherein the body includes a base and a cover, the base being formed during a first overmolding process, the cover being formed during a second overmolding process, the contacts being held by the base, the compensation component being mounted to the base and the contacts, the cover encasing at least a portion of the compensation component.

11. The connector assembly of claim 10, wherein the body is overmolded over the contacts and the compensation component such that a majority of the contacts are overmolded and a majority of the compensation component is overmolded.

12. The connector assembly of claim 10, wherein the contacts extend between mating ends and terminating ends, the gaps being positioned along the conductive paths remote from the mating ends and the terminating ends, the compensation component forming part of the conductive paths.

13. The connector assembly of claim 10, wherein the contacts extend between mating ends and terminating ends, the at least two adjacent contacts having portions thereof removed comprise a mating segment defined between the gap and the mating end and a mounting segment defined between the gap and the terminating end, the mating segments and the mounting segments having contact pads adjacent the gap, the compensation component being connected to the mating segments and the mounting segments at the contact pads thereof.

14. The connector assembly of claim 10, wherein the body is formed during a first overmolding process and a second overmolding process, the first overmolding process forming a supporting structure for the contacts leaving at least a portion of the contacts exposed, the gap being formed after the first overmolding process, the compensation component being coupled to the exposed portion of the contacts, the second overmolding process encasing at least a portion of the compensation component.

15. The connector assembly of claim 10, wherein the base has a channel exposing a portion of the contacts, the compensation component being mounted to the contacts within the channel, the cover at least partially filling the channel to at least partially encase the compensation component.

16. A connector assembly comprising;

a housing having a front and a rear; and contact modules loaded into the housing through the rear, each of the contact modules comprising:

a lead frame having contacts defining separate conductive paths, the lead frame defining a contact plane;

a compensation component coupled to selected contacts and affecting signals transmitted along the conductive paths of the selected contacts; and a body overmolded over the contacts and the compensation component, the body engaging the housing when the contact module is loaded into the housing;

wherein the contact modules are positioned within the housing such that the contact planes are parallel to one another.

17. The connector assembly of claim 16, wherein the contacts extend between mating ends and terminating ends, the contact modules further comprising cables terminated to the terminating ends of corresponding contacts, the terminating ends and portions of the cables being overmolded by the body.

18. The connector assembly of claim 16, wherein the body is formed during a first overmolding process and a second overmolding process, the first overmolding process forming a supporting structure for the contacts leaving at least a portion of the contacts exposed, a portion of at least one of the contacts being removed defining a gap along the contact such that the conductive path of such contact is non-continuous, the gap being formed after the first overmolding process, the compensation component being coupled to the exposed portion of the contact having the gap, the second overmolding process encasing at least a portion of the compensation component.

19. The connector assembly of claim 16, wherein the body includes a base and a cover, the base being formed during a first overmolding process, the cover being formed during a second overmolding process, the contacts being held by the base, the compensation component being mounted to the base and the contacts, the cover encasing at least a portion of the compensation component.

20. The connector assembly of claim 16, wherein the body includes a base and a cover, the base being formed during a first overmolding process, the cover being formed during a second overmolding process, the contacts being encased in the base, the base having a channel exposing a portion of the contacts, the compensation component being mounted to the contacts within the channel, the cover at least partially filling the channel to at least partially encase the compensation component.

* * * * *